United States Patent [19]

Krolczyk

[11] Patent Number: 5,042,411

[45] Date of Patent: Aug. 27, 1991

[54] COLLAPSIBLE CATAMARAN SAILBOAT

[76] Inventor: Ronald G. Krolczyk, 11855 Hovey, Warren, Mich. 48089

[21] Appl. No.: 471,831

[22] Filed: Jan. 29, 1990

[51] Int. Cl.[5] ..... B63B 1/12

[52] U.S. Cl. ..... 114/39.1; 114/61

[58] Field of Search ..... 114/39.1, 61, 354; 441/44–46

[56] References Cited

U.S. PATENT DOCUMENTS

| | | | |
|---|---|---|---|
| 2,712,293 | 7/1955 | Higgins | 114/61 |
| 3,045,263 | 7/1962 | Blachly | 114/61 |
| 3,571,831 | 3/1971 | Conklin | 114/61 X |
| 3,656,445 | 4/1972 | Padwick | 114/39.1 |
| 3,796,175 | 3/1974 | Ford Jr. et al. | 114/61 |
| 3,871,316 | 3/1975 | Woodrich | 114/61 |
| 3,986,219 | 10/1976 | Michowski | 114/61 |
| 4,557,210 | 12/1985 | Gerwin | 114/61 X |
| 4,766,830 | 8/1988 | Kunz | 114/61 |
| 4,796,555 | 1/1989 | Chang | 114/39.1 |
| 4,813,366 | 3/1989 | Elder | 114/61 |

*Primary Examiner*—Sherman Basinger
*Attorney, Agent, or Firm*—Basile and Hanlon

[57] ABSTRACT

A collapsible catamaran sailboat has a trampoline and a frame. The frame comprises two spaced cross tubes each having two ends. The frame further comprises two longitudinal, spaced hulls and a mechanism for releasably attaching one end of each cross tube to one of the hulls and the other end of each cross tube to the other of the hulls. The catamaran sailboat further comprises a mechnism for attaching the trampoline to the frame.

9 Claims, 2 Drawing Sheets

COLLAPSIBLE CATAMARAN SAILBOAT

BACKGROUND OF THE INVENTION

1. Field of the Invention

The present invention relates generally to collapsible catamarans and more specifically to a collapsible catamaran which uses the two hulls as part of the trampoline support frame.

2. Description of the Relevant Art

Collapsible catamarans in general are relatively well known in the art. For example, U.S. Pat. No. 4,796,555 issued to Chang discloses a knockdown inflatable sailboat, with a four or five sided frame attached to a pair of inflatable rafts. Each embodiment of this reference utilizes as part of the frame some type of stress rod running longitudinally to the raft or hull.

U.S. Pat. No. 4,766,830 issued to Kunz also discloses a catamaran with a collapsible frame. The reference teaches the use of a tubular frame which is made up of fore, aft and central sub-frame assemblies. The inflatable hulls are then attached to the undersides of the sub-frame assemblies.

These references, as well as other collapsible catamarans, call for at least a four sided frame which is then attached to the hulls or pontoons. The catamaran assemblies are often quite complex, involving many removable parts. This makes disassembly and transport time consuming and burdensome.

Thus, it would be desirable to provide a catamaran which is simple to assemble, disassemble and transport by actually using the hulls as part of the trampoline frame.

SUMMARY OF THE INVENTION

The present invention solves the above-listed problems by providing a collapsible catamaran sailboat which has a trampoline and a frame. The frame comprises two spaced cross tubes each having two ends. The frame further comprises two longitudinal, spaced hulls and means for releasably attaching one end of each cross tube to one of the hulls and the other end of each cross tube to the other of the hulls. The sailboat further includes means for attaching the trampoline to the frame.

BRIEF DESCRIPTION OF THE DRAWINGS

Other objects and features of the invention will become apparent by reference to the following specification and to the drawings in which.

DETAILED DESCRIPTION OF THE PREFERRED EMBODIMENT

Figure 1:
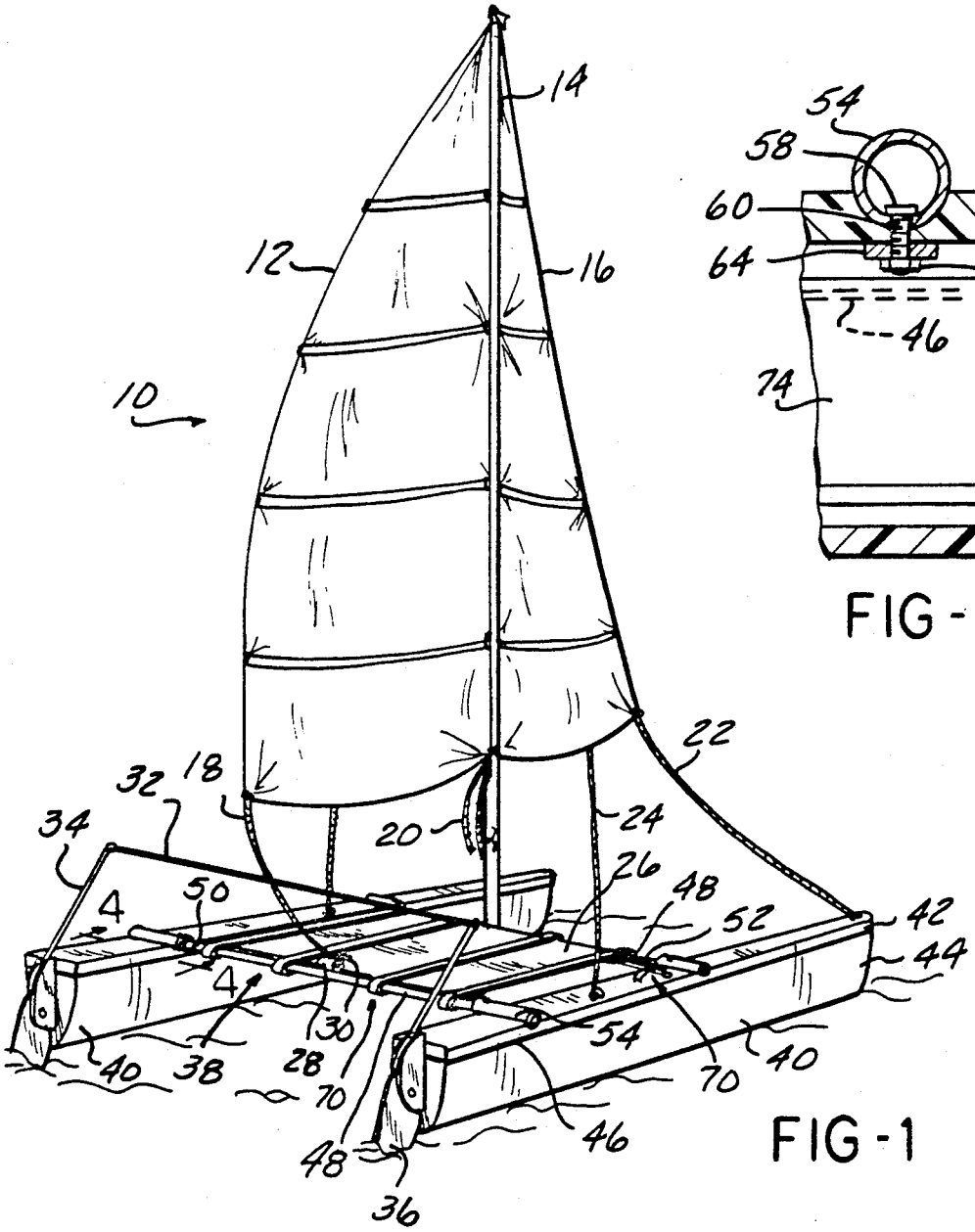
FIG. 1 is a perspective view of the assembled catamaran sailboat of the present invention.

Referring now to FIG. 1, the catamaran sailboat of the present invention is designated generally as 10. Catamaran 10 includes the following conventional elements: mainsail 12, mast 14, jib 16, main sheet 18, jib sheet 20, bridle 22, stays or shrouds 24, trampoline 26, main sheet block 28, cam cleat 30, tiller bar 32, tiller 34, and rudder 36. Sailboat 10 further comprises a frame 38. Frame 38 comprises two longitudinal, spaced hulls 40.

Figure 3:
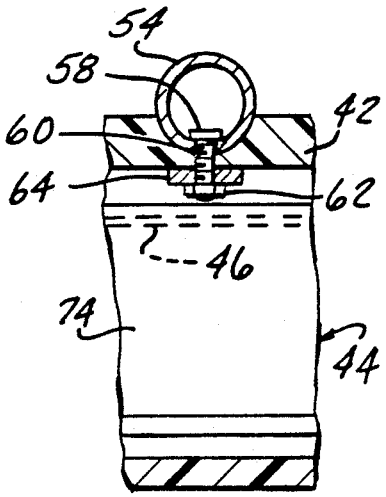
FIG. 3 is a cross sectional view taken on line 3—3 in FIG. 2 showing the cross tube connector affixing means.
Figure 4:
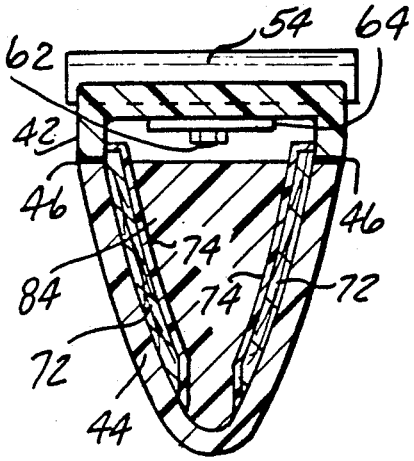
FIG. 4 is a cross sectional view taken on line 4—4 of FIG. 1.

Hull 40 may be made out of fiberglass, metal or any suitable material, including an injection molded plastic. The preferred material is fiberglass. Hulls 40 are formed in two separate portions 42, 44 as best seen in FIGS. 3 and 4. Lower portion 44 is hollow and is joined to upper portion 42 by means of adhesive 46 which is applied to the upper edges of hollow lower portion 44. Hollow lower portion 44 is filled with a closed cell urethane foam 84, to prevent hull 40 from filling with water if it was inadvertently punctured. As seen in FIG. 4, lower portion 44 may further comprise a lower portion hull support 72 running longitudinally inside each side of hull 40. Hull support 72 may be formed of any suitable material, and the preferred material is balsa wood. Hull support 72 is covered by a hull support covering 74, which may also be comprised of any suitable material. Preferably covering 74 is made from fiberglass. Hull support 72 is attached to hull 40 by any conventional means. Part of the adhesive 46 is under the upper portion of hull support 72, as seen in FIG. 4.

Frame 38 further comprises at least two spaced cross tubes 48 each having two ends 50, 52. Means are provided for releasably attaching one end, 50 or 52, of each cross tube 48 to one of the hulls 40 and the other end, 50 or 52, of each cross tube 48 to the other of the hulls 40.

Figure 2:
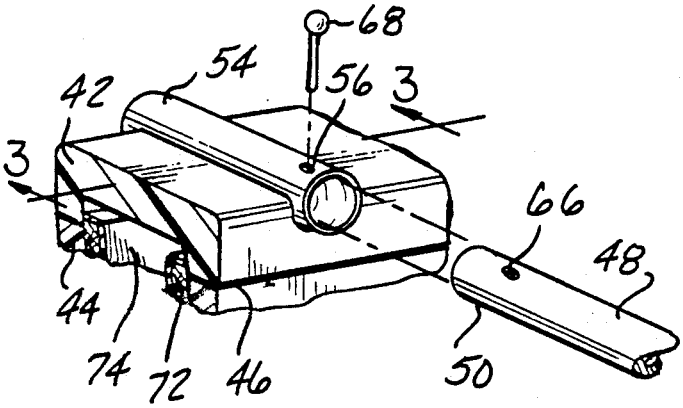
FIG. 2 is an enlarged, exploded cutaway view showing a cross tube connector, part of a cross tube and the securing pin.

Referring now to FIG. 2, the cross tube attaching means may comprise any suitable means including one where the cross tubes are connected directly to the hull by means of a spring loaded pin, a universal joint attached to a bayonet-type attachment (used conventionally in the sailboard industry) or the like. In the preferred embodiment, the cross tubing attaching means comprises a cross tube connector 54 which has a first aperture 56 and means for permanently affixing cross tube connector 54 to hull 40. As seen in FIG. 3, the affixing means comprises a bolt 58 which extends from the inside of cross tube connector 54 through a second cross tube connector aperture 60 and through upper portion 42 of hull 40. A nut 62 then secures bolt 60 to upper portion 42. For additional support, a support plate 64 may be added to the underside of upper portion 42. The support plate 64 comes between the lower part of cross tube connector 54 and nut 62. It is preferred that a support plate 64 does not directly contact cross tube connector 54, but rather $\frac{1}{4}$ inch to $\frac{3}{8}$ inch of the hull material, such as fiberglass, is between the bottom edge of cross tube connector 54 and support plate 64. Support plate 64 may be made of any suitable material, such as metal, a suitably rigid polymer, or the like.

The cross tube attaching means further comprises an aperture 66 in each end 50, 52 of each cross tube 48. A pin means 68 is receivable through first cross tube connector aperture 56 and one of the cross tube end apertures 66, as shown in FIG. 2. Pin means 68 secures end 50 or 52 of cross tube 48 within cross tube connector 54. Pin means 68 may comprise any suitable connecting pin.

Figure 5:
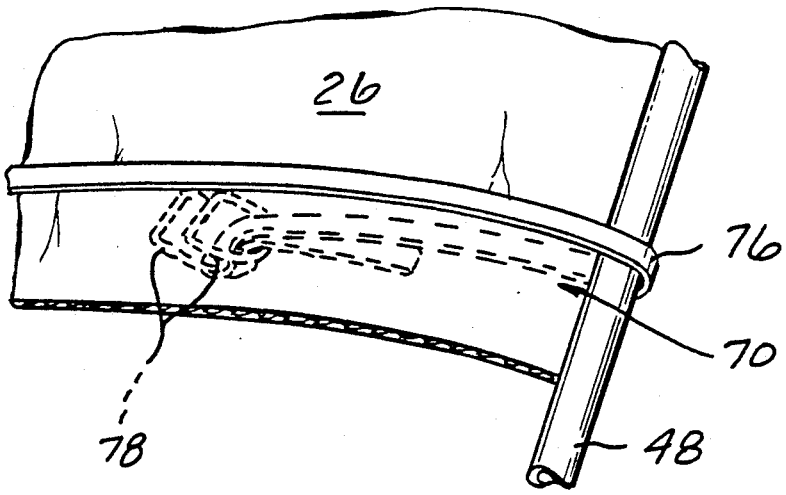
FIG. 5 is an enlarged cutaway perspective view showing the trampoline attaching means.

Sailboat 10 further comprises means 70 for attaching trampoline 26 to frame 38. This attaching means 70 may comprise any suitable means. In the preferred embodiment, as best seen in FIG. 5, this trampoline attaching means 70 comprises a first strap 76 having first and second ends. The first strap first end is attached to trampoline 26, with the first strap being extendable around cross tube 48. A first hook means, attached to the trampoline, receives the second end of the first strap. This first hook means may comprise any suitable means. In the preferred embodiment, it comprises the conventional double D rings 78 wherein the first strap second end would go through the center of both D rings, then over one of the D rings and under the other of the rings.

Figure 6:
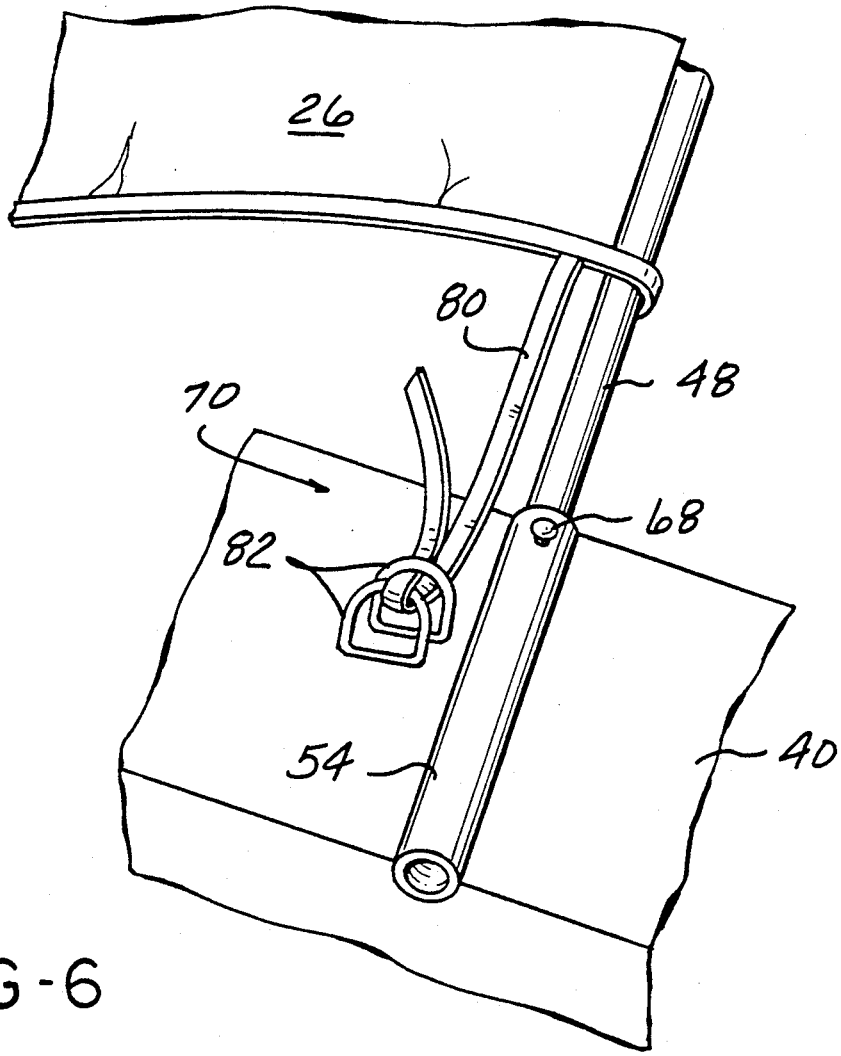
FIG. 6 is an enlarged cutaway perspective view showing the trampoline attaching means adjacent the hull.

As best seen in FIG. 6, a second strap 80 has first and second ends. The second strap first end is attached to trampoline 26. A second hook means, attached to the hull 40, receives the second end of the second strap. The second hook means may similarly comprise any suitable means, and double D rings 82 are preferred. Additionally, the trampoline attaching means may comprise a means which would removably or permanently attach trampoline 26. The use of the double D rings removably attaches trampoline 26.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

What is claimed is:

1. In a collapsible catamaran sailboat having a trampoline, the improvement comprising;

a quick-assemble frame, comprising:

two spaced cross tubes each having two ends;

two longitudinal, spaced hulls; and means for releasably attaching one end of each cross tube to one of the hulls and the other end of each cross tube to the other of the hulls; and means for rapidly and releasably attaching the trampoline to the frame, wherein the rapid and releasable trampoline attaching means comprises:

a first strap having first and second ends, the first end being attached to the trampoline, the first strap being extendable around the cross tube;

first hook means, attached to the trampoline, for receiving the second end of the first strap;

a second strap having first and second ends, the first end being attached to the trampoline; and second hook means, attached to one of the hulls, for receiving the second end of the second strap.

2. The sailboat as defined in claim 1 wherein the cross tube attaching means comprises:

a cross tube connector having a first aperture;

means for permanently affixing the cross tube connector to the hull;

an aperture in each end of each cross tube; and pin means, receivable through the first cross tube connector aperture and one of the cross tube end apertures, for securing the end of the cross tube within the cross tube connector.

3. The sailboat as defined in claim 2 wherein the cross tube connector has an inside and a second aperture, and the affixing means comprises:

a bolt extending from the inside of the cross tube connector through the second aperture and into the hull; and a nut securing the bolt to the hull.

4. The sailboat as defined in claim 3 wherein the hulls are formed out of fiberglass.

5. The sailboat as defined in claim 4 wherein the affixing means further comprises a support plate within the hull, the plate being between the cross tube connector and the nut.

6. The sailboat as defined in claim 1 wherein the hulls are formed out of metal.

7. In a collapsible catamaran sailboat having a trampoline, the improvement comprising:

a quick-assemble frame, comprising:

two longitudinal, spaced, fiberglass hulls, each of the hulls comprising:

an upper portion;

a lower hollow portion having an upper edge;

means for adhering the upper portion to the lower portion upper edge;

means, disposed within the hull, for preventing liquid from entering the hull;

means, disposed within the hollow lower portion, for longitudinally supporting the hull;

two spaced cross tubes each having two ends and an aperture in each end, the cross tubes extending tranversely between the two hulls;

four cross tube connectors, each having an inside and first and second apertures, each cross tube connector receiving one of the cross tube ends;

a bolt extending from the inside of each cross tube connector through the second aperture and into the hull;

a nut securing each bolt to the hull;

a support plate within the hull, the plate being between the cross tube connector and the nut; and pin means, receivable through the first cross tube connector aperture and one of the cross tube end apertures, for releasably securing the end of the cross tube within the cross tube connector;

a first strap having first and second ends, the first end being attached to the trampoline, the first strap being extendable around the cross tube;

first hook means, attached to the trampoline, for receiving the second end of the first strap;

a second strap having first and second ends, the first end being attached to the trampoline; and second hook means, attached to the hull, for receiving the second end of the second strap.

8. The sailboat as defined in claim 7 wherein the liquid preventing means comprises a closed cell urethane foam.

9. The sailboat as defined in claim 7 wherein the longitudinal support means comprises balsa wood covered by a fiberglass hull support covering.

* * * * *